US005168845A

United States Patent [19]

Peaker

[11] Patent Number: 5,168,845

[45] Date of Patent: Dec. 8, 1992

[54] AUXILIARY OIL PUMP APPARATUS

[76] Inventor: Jackie L. Peaker, Rte. 2, Box 118-A, Chouteau, Okla. 74337

[21] Appl. No.: 879,299

[22] Filed: May 7, 1992

[51] Int. Cl.[5] ..... F01M 5/00

[52] U.S. Cl. ..... 123/196 S; 123/196 AB; 184/104.2

[58] Field of Search ..... 123/196 R, 196 S, 196 AB; 184/6.4, 104.2, 106

[56] References Cited

U.S. PATENT DOCUMENTS

| | | | |
|---|---|---|---|
| 1,920,805 | 8/1933 | Randolph | 123/196 AB |
| 2,357,606 | 9/1944 | Nutt | 184/104.1 |
| 2,838,039 | 6/1958 | Smith et al. | 123/196 S |
| 2,899,530 | 8/1959 | Wunstorf | 123/196 AB |
| 4,105,092 | 8/1978 | Zeidler et al. | 123/196 S |
| 4,296,716 | 10/1981 | Hofbauer et al. | 123/196 AB |
| 4,936,272 | 6/1990 | Whitmore | 123/196 S |
| 4,986,235 | 1/1991 | Ishii et al. | 123/195 C |
| 5,000,143 | 3/1991 | Brown | 123/196 S |
| 5,121,720 | 6/1992 | Roberts | 123/196 S |

FOREIGN PATENT DOCUMENTS

| | | | |
|---|---|---|---|
| 0901596 | 1/1982 | U.S.S.R. | 123/196 S |

*Primary Examiner*—Willis R. Wolfe
*Assistant Examiner*—Erick Solis
*Attorney, Agent, or Firm*—Leon Gilden

[57] ABSTRACT

An auxiliary oil pump selectively operative is mounted in fluid communication with a primary oil pump relative to an internal combustion engine, wherein the auxiliary oil pump is arranged for prelubrication of an existing internal combustion engine.

5 Claims, 4 Drawing Sheets

AUXILIARY OIL PUMP APPARATUS

BACKGROUND OF THE INVENTION

1. Field of the Invention

The field of invention relates to prelubrication apparatus, and more particularly pertains to a new and improved auxiliary oil pump apparatus wherein the same is directed to the preliminary lubrication of an internal combustion engine prior to operation thereof.

2. Description of the Prior Art

Prelubrication of various automobile engines and internal combustion engines in general has been recognized in the prior art as a remedy for a problem to minimize accelerated abrasion between various reciprocating and relatively moving components within the internal combustion engine. Such apparatus is exemplified in U.S. Pat. Nos. 4,112,910; 4,524,734; 4,875,551; 4,940,114; and 4,936,272.

Accordingly, it may be appreciated that there continues to be a need for a new and improved auxiliary oil pump apparatus as set forth by the instant invention which addresses both the problems of ease of use as well as effectiveness in construction and in this respect, the present invention substantially fulfills this need.

SUMMARY OF THE INVENTION

In view of the foregoing disadvantages inherent in the known types of prelubrication apparatus now present in the prior art, the present invention provides an auxiliary oil pump apparatus wherein the same is arranged to direct lubrication into an oil galley of an associated internal combustion engine prior to operation thereof. As such, the general purpose of the present invention, which will be described subsequently in greater detail, is to provide a new and improved auxiliary oil pump apparatus which has all the advantages of the prior art oil pump apparatus and none of the disadvantages.

To attain this, the present invention provides an auxiliary oil pump selectively operative mounted in fluid communication with a primary oil pump relative to an internal combustion engine, wherein the auxiliary oil pump is arranged for prelubrication of an existing internal combustion engine.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved auxiliary oil pump apparatus which has all the advantages of the prior art oil pump apparatus and none of the disadvantages.

It is another object of the present invention to provide a new and improved auxiliary oil pump apparatus which may be easily and efficiently manufactured and marketed.

It is a further object of the present invention to provide a new and improved auxiliary oil pump apparatus which is of a durable and reliable construction.

An even further object of the present invention is to provide a new and improved auxiliary oil pump apparatus which is susceptible of a low cost of manufacture with regard to both materials and labor, and which accordingly is then susceptible of low prices of sale to the consuming public, thereby making such auxiliary oil pump apparatus economically available to the buying public.

Still yet another object of the present invention is to provide a new and improved auxiliary oil pump apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
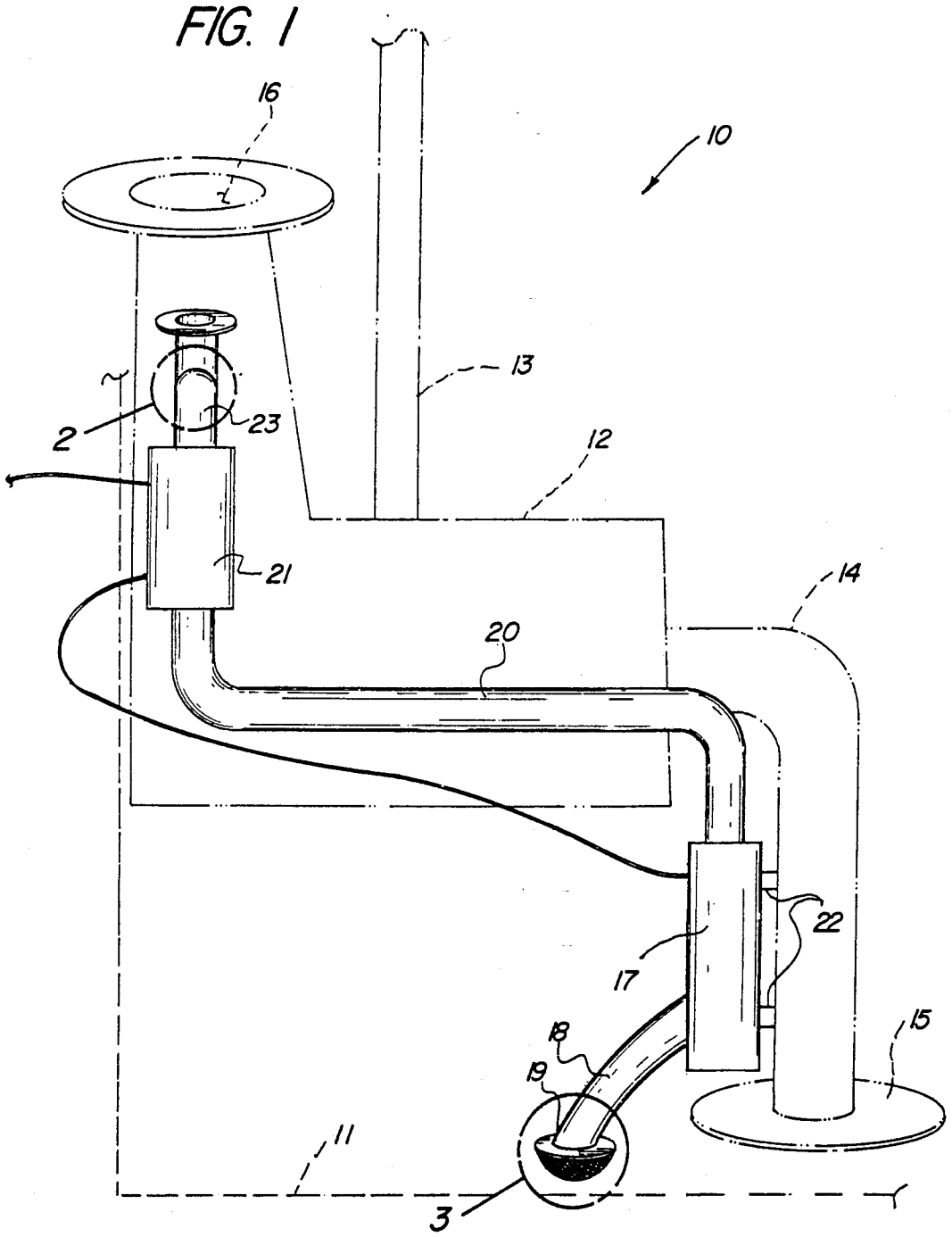
FIG. 1 is an orthographic side view of the instant invention.
Figure 2:
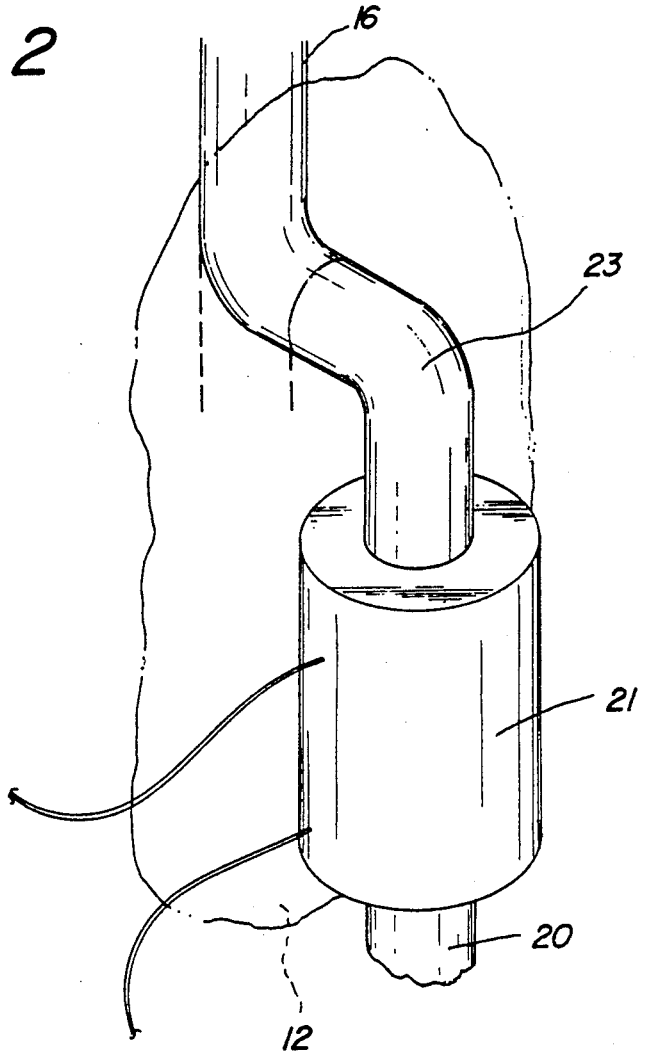
FIG. 2 is an isometric illustration, somewhat enlarged, of section 2 as set forth in FIG. 1.
Figure 3:
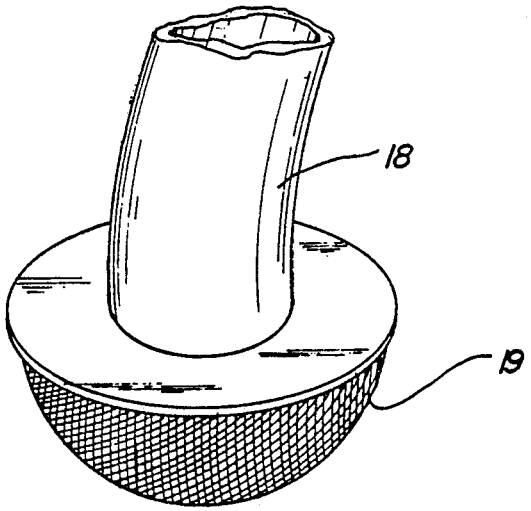
FIG. 3 is an isometric illustration of the pickup screen structure of the auxilialry oil pump.
Figure 5:
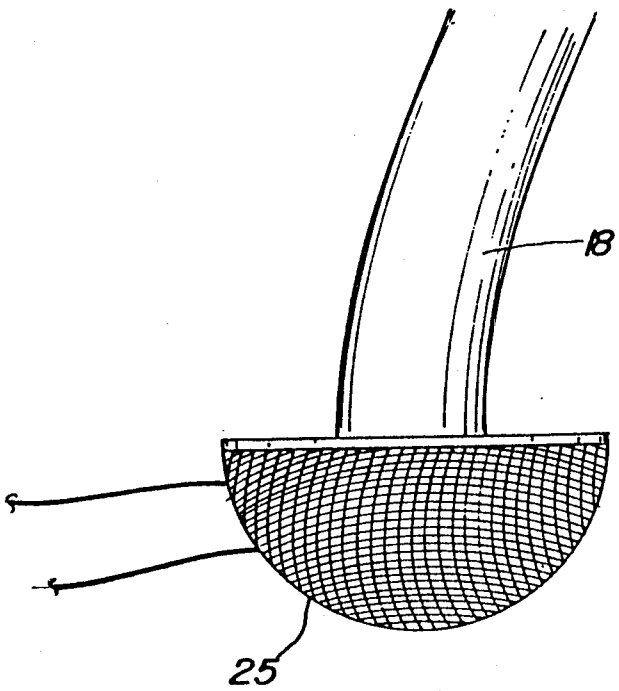
FIG. 5 is an orthographic side view of the pickup screen utilizing a resistance heating grid.

With reference now to the drawings, and in particular to FIGS. 1 to 7 thereof, a new amd improved auxiliary oil pump apparatus embodying the principles and concepts of the present invention and generally designated by the reference numeral 10 will be described.

More specifically, the auxiliary oil pump apparatus 10 of the instant invention is arranged to direct preliminary lubrication to an internal combustion engine, in a manner as set forth in U.S. Pat. No. 4,936,272 incorporated herein by reference. In this manner, the internal combustion engine employs an oil pump 12 mounted within a vehicular oil pan 11, wherein an oil pump drive 13 effects suctioning of existing oil through a first pickup screen 15 into a first pickup tube 14 to direct such oil into the internal combustion engine (not shown) through an oil pump outlet conduit 16.

An auxiliary oil pump 17 is provided having an auxiliary oil pump pickup tube 18 formed with a second oil pump pickup tube screen 19 at its free distal end to direct lubrication therethrough. An intermediate oil conduit 20 is in fluid communication between the auxiliary oil pump 17 and a check valve 21. The check valve 21 may be further provided with a pressure switch to control pressure output from the auxiliary oil pump 17 into a delivery oil conduit 23. The delivery oil conduit 23 directs lubrication oil from the auxiliary oil pump 17 into fluid communication with the oil pump outlet conduit 16 (see FIG. 2). Further, it should be noted that at least one, if not a plurality, of mounting links 22 fixedly secure the auxiliary oil pump 17 relative to the existing first pickup tube 14 to maintain fixed orientation and positioning of the auxiliary oil pump 17 within the vehicular oil pan 11.

Figure 4:
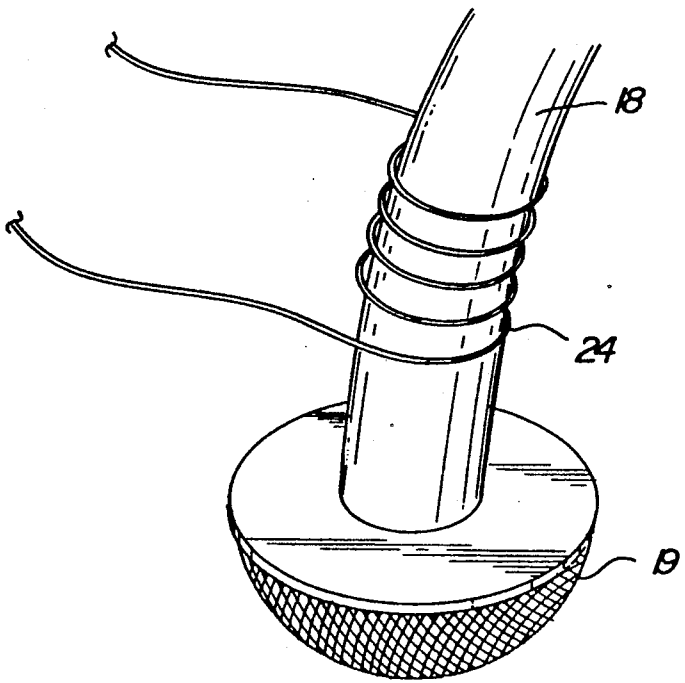
FIG. 4 is an isometric illustration of the auxiliary oil pump utilizing resistance heating wire.

The FIG. 4 illustrates the use of a resistance heating coil 24 mounted in surrounding relationship relative to the auxiliary oil pickup tube 18. By contrast, the modified auxiliary or second pickup tube screen is formed as a resistance heating screen grid 25 of a first mesh size and opening. In this manner, preheating of oil within the oil pan is available particularly in geographical locations of lowered ambient temperature where oil flow is inhibited due to increased viscosity.

Figure 6:
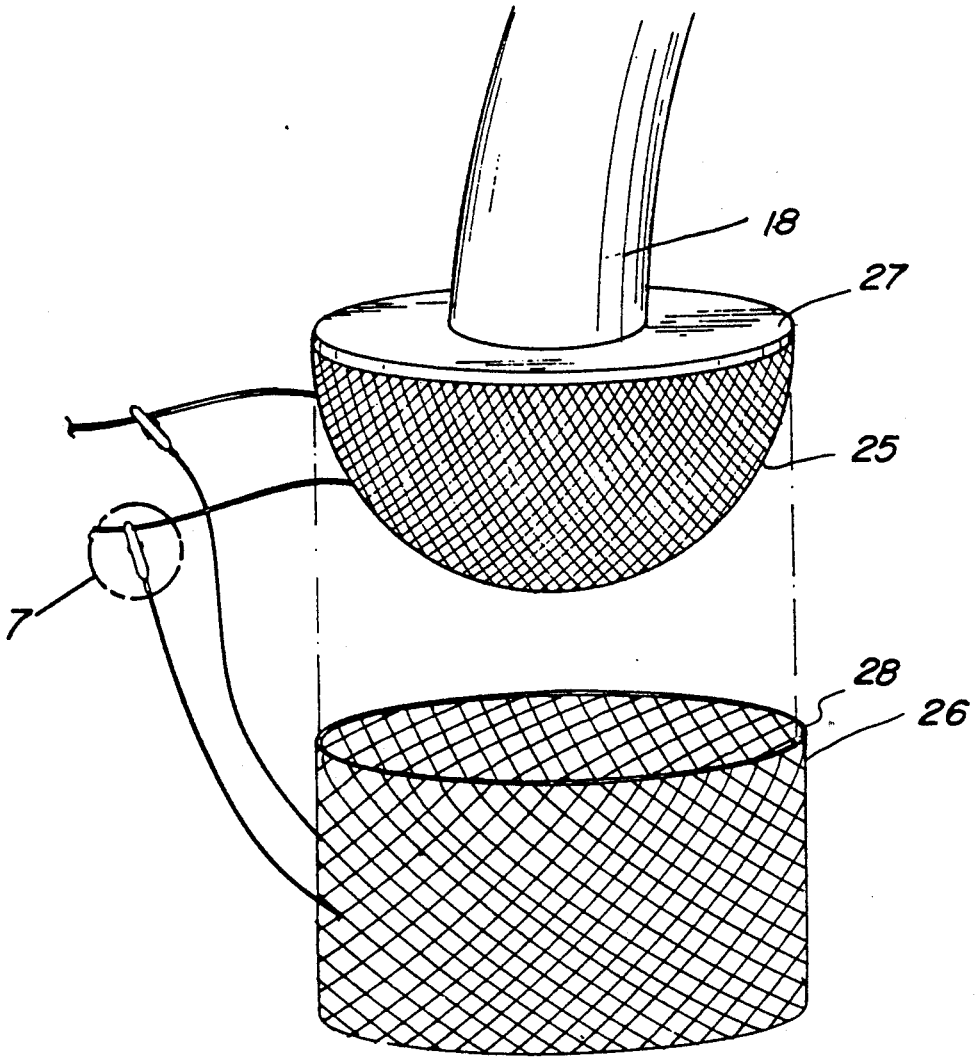
FIG. 6 is an isometric illustration of the pickup screen in association with an auxiliary heating grid.

The FIG. 6 notes the use as required when additional heating of the oil within the oil pan 11 is necessitated of a mesh basket 26 formed of electrical resistance heating grid having a second mesh size and opening greater than the first mesh size to permit unimpeded oil flow through the first heating of the mesh basket 26 into a secondary heating of the resistance heating screen grid 25. The further mesh basket 26 has a mesh basket mounting rib 28 of a predetermined configuration fixedly secured to the screen grid mounting plate 27 mounting the screen grid 25 also of said predetermined configuration to effect required oil flow through the mesh basket 26 and into the resistance screen grid 25 to provide for dual heating when thusly warranted by existing depressed temperature conditions.

It should be noted that electrical energy to be directed to the auxiliary oil pump 17, as well as the resistance screen grid 25 and the mesh basket 26, is available through use of an existing automotive battery as conventionally found in contemporary vehicles. Alternatively, an alternating current may be provided for operation of the auxiliary oil pump in the mesh basket 26, as well as the screen grid 25 if required utilizing conventional circuitry available to one of ordinary skill in the art.

Figure 7:
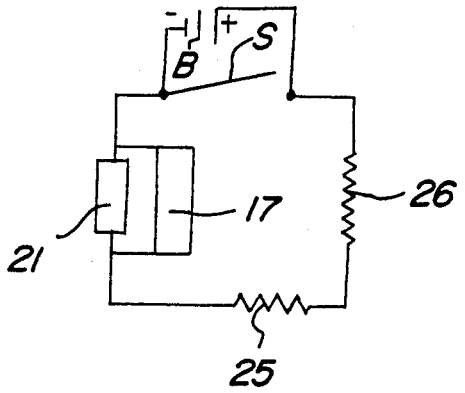
FIG. 7 is a schematic illustration of typical electrical circuitry available for use by the invention.

FIG. 7 illustrates a typical conventional circuitry utilizing the vehicular battery "B" operative through a switch "S" to direct electrical energy through the auxiliary oil pump 17 through the check valve 21 which may be further employed as a pressure switch. The mesh screen rid 25, as well as the basket 26, thereby receive electrical energy for their simultaneous actuation with the auxiliary oil pump 17. It should be noted if desired that separate switching may be available (not shown) to permit selective actuation of the resistance heating members 25 and 26 relative to the auxiliary oil pump 17.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. An auxiliary oil pump apparatus, comprising in combination, a vehicular oil pan having a main oil pump, the main oil pump including a first pickup tube, with the first pickup tube including a first pickup screen at a free distal end of the first pickup tube, and an outlet conduit for directing pressurized oil into an associated internal combustion engine, and an auxiliary oil pump fixedly mounted to the first pickup tube with the auxiliary oil pump including an auxiliary oil pump pickup tube and an auxiliary oil pump pickup screen at a free distal end of the auxiliary oil pump pickup tube, and a delivery oil conduit to direct fluid flow into the oil pump outlet conduit.

2. An apparatus as set forth in claim 1 wherein the auxiliary oil pump includes a check valve, and an intermediate oil conduit is in fluid communication between the auxiliary oil pump and the ckeck valve, and the delivery oil conduit is directed from the check valve into the oil pump outlet conduit.

3. An apparatus as set forth in claim 2 including at least one mounting link fixedly mounted between the auxiliary oil pump and the first pickup tube.

4. An apparatus as set forth in claim 3 wherein the auxiliary oil pump pickup screen is formed of a resistance heating coil for selective actuation.

5. An apparatus as set forth in claim 4 wherein the auxiliary oil pump pickup tube includes a mounting plate fixedly secured to a free distal end of the auxiliary oil pump pickup tube, wherein the mounting plate is of a predetermined configuration, and a mesh basket formed of electrical resistance heating fabric having a mounting rim equal to said predetermined configuration fixedly secured to said mounting plate, and said mesh basket is of a second mesh size and second mesh size opening, wherein the auxiliary oil pump pickup screen is formed of a first mesh size and first size opening less than said second mesh size opening, wherein said mesh basket is in electrical communication with said auxiliary oil pump screen which is in electrical communication with said auxiliary oil pump.

* * * * *